United States Patent [19]

Rostron et al.

[11] Patent Number: 4,510,477

[45] Date of Patent: Apr. 9, 1985

[54] CURRENT TRANSFORMER

[75] Inventors: Joseph R. Rostron, Franklin Township; John R. Perulfi, Monroeville, both of Pa.

[73] Assignee: Westinghouse Electric Corp., Pittsburgh, Pa.

[21] Appl. No.: 543,644

[22] Filed: Oct. 19, 1983

[51] Int. Cl.[3] ..... H01F 27/02

[52] U.S. Cl. ..... 336/92; 336/94; 336/174

[58] Field of Search ..... 336/55, 58, 92, 94, 336/100, 173, 174, 175

[56] References Cited

U.S. PATENT DOCUMENTS

| | | | |
|---|---|---|---|
| 2,549,426 | 4/1951 | Clark et al. | 175/358 |
| 2,601,042 | 6/1952 | Marks | 175/358 |
| 2,804,577 | 8/1957 | Roth | 317/28 |
| 2,849,694 | 8/1958 | Prince | 336/174 |
| 2,997,676 | 8/1961 | Peuron et al. | 336/58 |
| 3,125,736 | 3/1964 | Aronson et al. | 336/100 |
| 3,571,773 | 3/1971 | Johnston et al. | 336/92 |
| 4,132,853 | 1/1979 | Wagenaar | 174/12 BH |

FOREIGN PATENT DOCUMENTS

| | | | |
|---|---|---|---|
| 850988 | 12/1939 | France | 336/100 |

*Primary Examiner*—A. D. Pellinen
*Assistant Examiner*—Susan Steward
*Attorney, Agent, or Firm*—L. P. Johns

[57] ABSTRACT

A current transformer characterized by a terminal bushing extending from a tank with a pair of spaced conductors extending through the bushing and into the tank and with the portions of the conductors in the tank being enclosed within tubular means. The assembly of the conductors, bushing, and tubular means being clamped together by resilient (spring) means for holding the conductors in tension and the bushing and tubular means in compression. The transformer also embodies two separate oil systems.

7 Claims, 4 Drawing Figures

CURRENT TRANSFORMER

BACKGROUND OF THE INVENTION

1. Field of the Invention

This invention relates to a high voltage current transformer and, more particularly, to such a transformer having clamping means for a self-contained unit with two oil systems.

2. Description of the Prior Art

The primary winding of high voltage current transformers operates at a high voltage to ground, with a low voltage drop across its terminals. Generally, current transformers of prior construction having employed various types of mounting means. For example, in U.S. Pat. No. 2,849,694, a pair of elongated bushing cores are mounted to extend throughout their lengths in closely-spaced, substantially-parallel relationship. The conductive studs of the bushing cores are suspended from the top of the ceramic shell, and they extend downwardly into a tank assembly. A single oil system insulates and cools the current transformer. In U.S. Pat. No. 2,549,426, a primary conductor is contained within a rigid insulating tube which is supported by spaced gasketed rings at the upper and lower ends of a porcelain shell. Again, a single oil insulating and cooling system is used.

Moreover, some current transformers of prior-art construction embodied the so-called "eye-bolt" or "U-shaped" type of primary winding as disclosed in U.S. Pat. Nos. 2,804,577 and 4,052,685. These constructions consist of sharp-turned primary winding structures that require non-automated, labor-intensive, hand-wrapped paper insulation. Many of such transformers have also included tie-rod or cemented joints between porcelain bushings and adjacent parts that were rigid assemblies rather than flexible and, therefore, not resistant to exceptional seismic activities.

SUMMARY OF THE INVENTION

The current transformer of this invention comprises a tank having a detachable cover through which a condenser bushing assembly extends from the cover with a pair of elongated primary conductors depending from the upper end of the bushing and into the tank. Each conductor has internal and external end portions with a connector extending between the internal end portions within the tank. The inner end portions are contained within tubular means around each conductor extending from the tank cover to the connector. Mounting means are provided for holding together the assembly of the conductors, bushing, and tubular means, and including spring means for applying tension to the conductors and compression to and between the bushing and tubular means. A secondary winding is disposed around one of the conductors. In addition, the conductors are immersed in a first oil system and the bushings are immersed in a second oil system.

The advantage of the invention is that the primary winding of this current transformer and a tank top may be assembled outside of a tank with its own self-contained oil system as a unit into a tank containing a second oil system, independent of the first, by fastening the tank top and tank together. The use of spring assembly places the porcelain bushings in compression. This provides a chamber around the primary winding of the current transformer in which an oil is provided, separate and independent of another oil system within the tank. At the same time the spring assembly provides a flexible unit that is able to move as a non-rigid unit in response to exceptional seismic activity.

DESCRIPTION OF THE PREFERRED EMBODIMENTS

Figure 1:
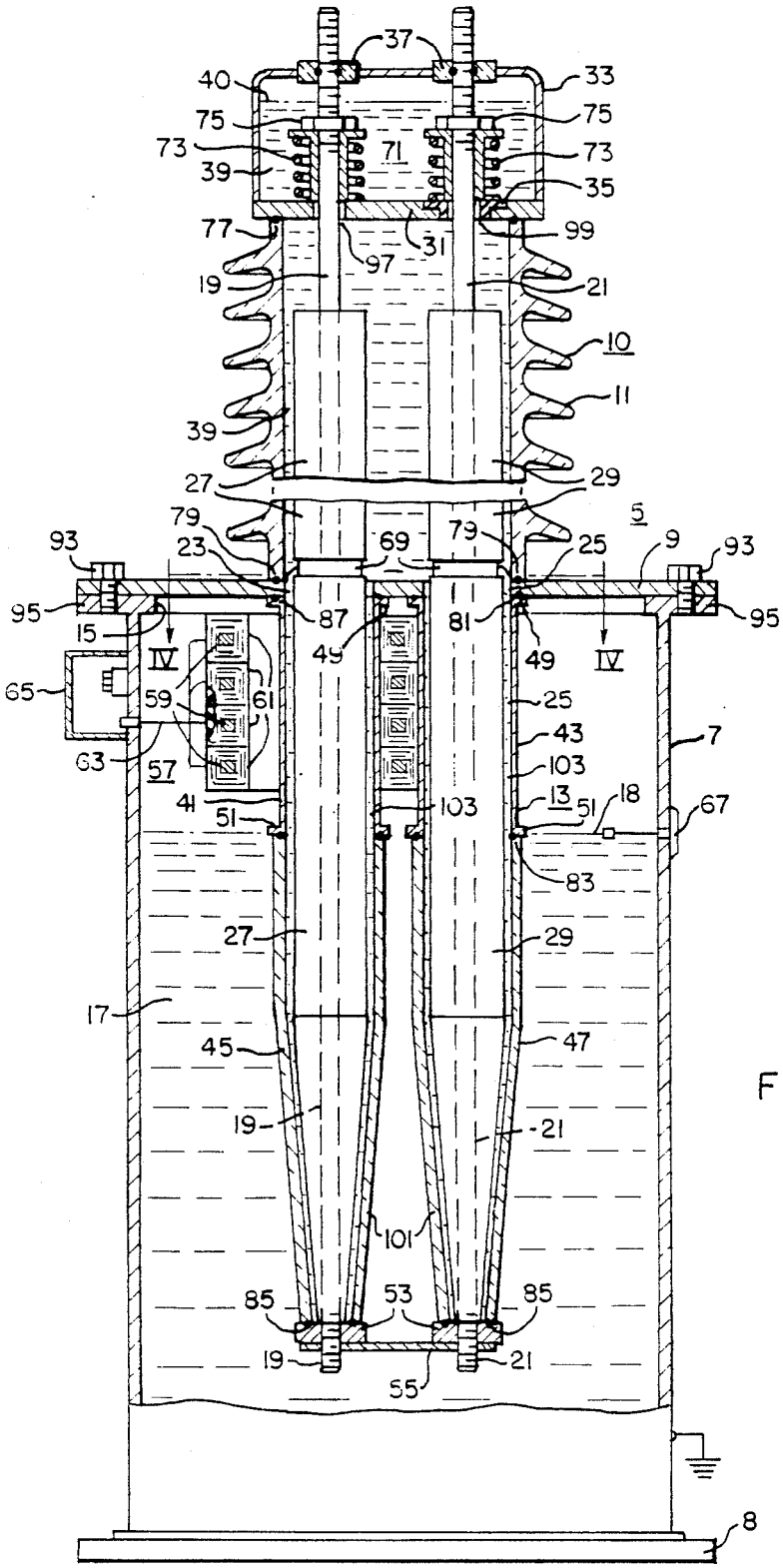
FIG. 1 is a vertical sectional view of a current transformer in accordance with this invention.

A current transformer is generally indicated at 5 (FIG. 1) and it comprises a grounded metallic tank 7 having a tank cover 9, and a conductor-bushing unit. The assembly comprises upper and lower portions 11, 13, above and below, the tank cover 9.

The tank 7 includes a base 8 at its lower end, and an open upper end 15 which is closed by the tank cover 9 when assembled. The tank forms a chamber or receptacle for a first oil system including an insulating fluid 17 which may be liquid or gas, such as mineral oil (having a level 18), or insulating gas, for example, sulfur hexafluoride ($SF_6$).

The conductor-bushing unit is a high voltage unit comprising a shell or tubular bushing 10 that surrounds a pair of elongated conductors or studs 19, 21 that extend through corresponding openings 23, 25 in the tank cover 9. The conductors 19, 21 comprise upper or external conductor portions above the tank cover and lower or internal conductor portions below the tank cover. Each conductor is encased within a condenser bushing 27, 29. The upper end portions of the conductors 19, 21 extend above the upper portion or shell 11 and extend through a cover 31 and into a bushing bowl 33 atop the cover. The cover 31 may be composed of a dielectric material, but is preferably composed of a conducting non-magnetic metal, such as aluminum, copper, or stainless steel. Where the cover is metallic, an insulating spacer 35 is provided around one of the conductors, such as the conductor 21. Likewise, the bushing bowl 33 may be comprised of a non-metallic, or metallic material such as copper. Inasmuch as the upper ends of the conductors 19, 21 extend through the top of the bushing bowl, similar gaskets 37 surround the conductors for insulating purposes as well as to help retain insulating fluid intact, as described hereinbelow.

The lower portion 13 of the conductor-bushing unit below the tank cover 9 comprises the lower end portions of the conductors 19, 21 contained within corresponding condenser bushings 27, 29. The condensers are composed of layers of dielectric material, such as paper, and of electrically graded conducting foils between the layers of paper. The assembly of the conductors and condensers is contained within tubular shell means or tubes 41, 43 and bushing tubes 45, 47. The tubes 41, 43 are preferably composed of a conductive material, such as aluminum or steel, and are provided with similar upper flanges 49 and similar lower flanges 51. The tubes 45, 47 are preferably truncated to adapt to tapered lower ends of the condenser bushings 27, 29. Like the shell or tubular bushing 10, the tubes 45, 47 are preferably composed of a dielectric material, such as porcelain or epoxy.

Each pair of tubes 41, 45 and 43, 47 is retained in place by a support member 53 which are suitably attached to the lower ends of the respective conductors by threaded or brazed joints. An electrical connector 55 extends between the lower ends of the conductors 19, 21, and is composed of a metal, such as copper or aluminum.

A secondary transformer structure 57 is mounted on one of the conductors, such as conductor 19. The structure 57 comprises a plurality of spaced magnetic cores 59 in inductive relation with corresponding windings 61. The structure 57 is annular and surrounds the assembly of the conductor 19, condenser bushing 27, and tube 41. Terminal leads 63 extend from the windings 61 to a junction box 65. Inasmuch as the windings 61 of the transformer structure 57 are adequately wrapped in layers of insulation (not shown), the transformer structure is disposed in the space above the level 18 of the insulating fluid 17 which level is monitored by an oil gauge 67.

An outer layer of paper is stripped from each condenser bushing 27, 29 in order to expose ground foils 16 which are connected to the tank cover 9 which grounds the foil to the tank to provide a ground potential.

Figure 2:
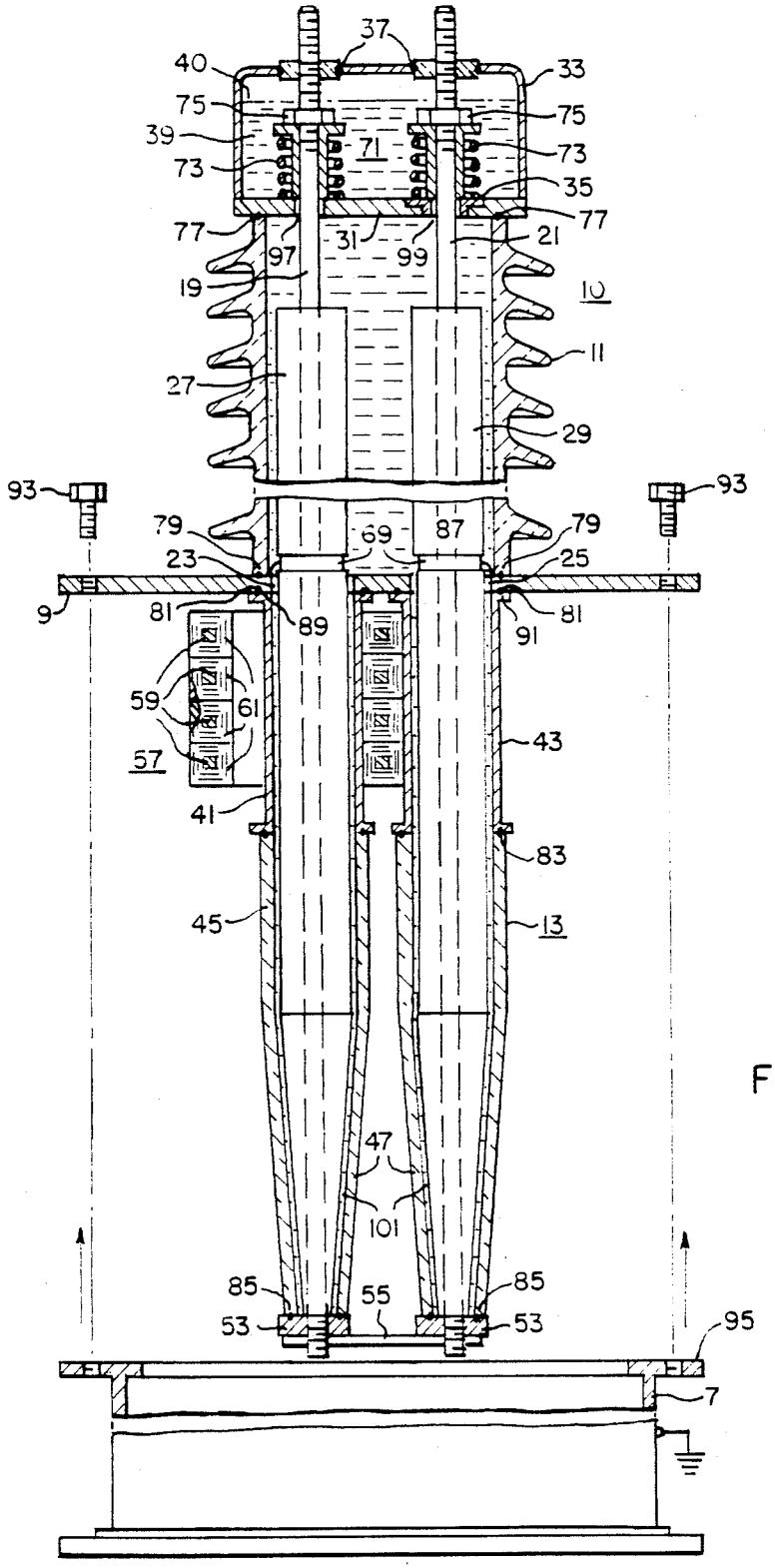
FIG. 2 is an exploded view of the transformer showing preassembled unit and the tank in section.
Figure 4:
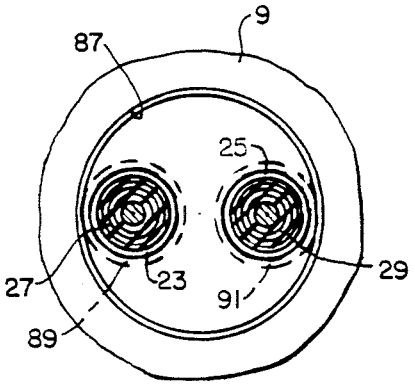
FIG. 4 is a horizontal sectional view taken on line IV—IV of FIG. 1

In accordance with this invention mounting means generally indicated at 71 (FIG. 1) are provided for resiliently biasing the conductors 19, 21 in tension and the tubular shell means (including the bushing 10 and tubes 41 43, 45, 47) in compression between the upper and lower end portions of the tubular shell means. The mounting means for each conductor include a spring assembly comprised of a plurality of springs, such as two similar coil springs 73, and the cover 31 at the upper end of the shell 10. The mounting means 71 also comprises tightening nuts 75 mounted on the upper threaded portions of the conductors 19, 21 for exerting tensile stress on the springs 73. More particularly, as shown in FIG. 2, the mounting means 71 holds the conductor-bushing unit together by applying compression through the cover 31, the shell 10, the tank cover 9, the separate tubes 41, 43, the separate tubes 47, 49, and the support members 53. The several joints between those parts are leakproof by the use of suitable gasketing means 77, 79, 81, 83, and 85, such as flat gaskets or O-rings. Where the gasketing means are O-rings, ring-receiving grooves are provided at abutting surfaces, such as grooves 87, 89, and 91, (FIG. 4) in the upper and lower surfaces of the tank cover 9. Thus, the tubular shell members are held in compression through the cover plate 9 between the support members 53 and the nuts 75, while the conductors 19, 21 are held in tension.

In addition to retaining the several parts in a tension-compression relationship as set forth above, the mounting means 71 provides the additional advantage of enabling pre-assembly of the conductor-bushing unit outside of the tank 7, the assembled unit is subsequently inserted into the tank 7 as shown in FIG. 2. Thereafter, the tank cover may be secured in a fluidtight manner, such as by bolts 93, to a tank flange 95 (FIG. 1).

The conductor-bushing unit is fluidtight from the upper to the lower ends. It comprises a plurality of intercommunicating spaces including annular spaces 101, 103 between the condenser bushings 27 and the tubes 43, 45, respectively, the openings 23, 25 in the tank cover 9, the inner chamber within the shell 10, the holes 97, 99 in the cover 31, and the chamber within the housing bowl 33. The insulating fluid 39 occupies the entire space within the conductor-bushing unit and has an upper level 40 within the bushing bowl 33.

Accordingly, the tank cover 9 generally separates and forms a common interface between the two oil systems 17, 39, whereby the conductors 19, 21 are completely immersed in the first oil system of the fluid 39 while the second oil system including fluid 17 is contained within the tank 7 at the level 18.

Although the conductor-bushing unit may be filled with oil or fluid prior to shipment, it is preferably filled in the field. The bushing oil and the tank oil are separated, because the former has a higher purity and a lower moisture content for which reason it is more sensitive to moisture and contamination than the tank oil.

Figure 3:
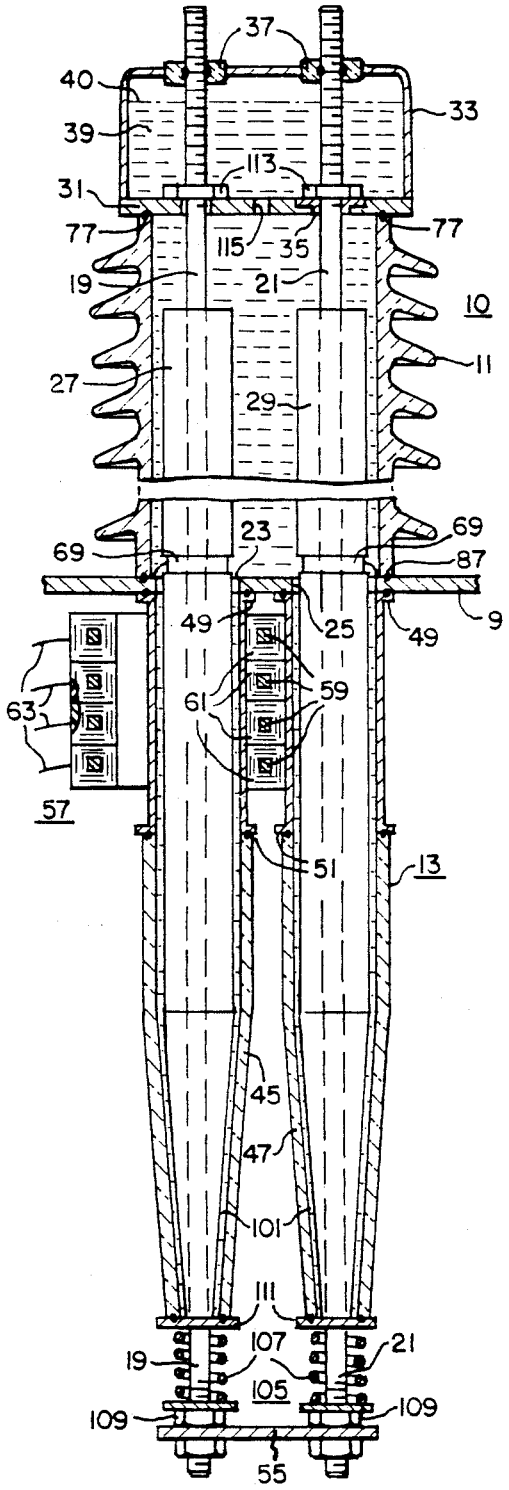
FIG. 3 is a vertical sectional view of another embodiment of the invention.

Another embodiment of the invention is shown in FIG. 3 in which similar numerals refer to similar parts. In this embodiment mounting means 105 are provided at the lower end of conductor-bushing unit and include coil springs 107 similar to the spring 73 (FIG. 2). Compression nuts 109 similar to the nuts 75 are tightened against the springs on the threaded lower end portions of the conductors 27, 29. Thus, the springs 107 bear against support members 111 to seal the lower end of the tubes 45, 47. With this embodiment spanner nuts 113 engage the upper threaded end portions of the conductors 27, 29 for holding the cover 31 tightly against the upper end of the shell 10. A passage 115 is provided in the cover 31 to provide communication between the compartments above and below the cover.

In still another embodiment, the mounting means may include mounting means 71 (FIG. 1) at the upper end of the conductors 27, 29 as well as the mounting means 105 (FIG. 3) at the lower end thereof if desirable.

In conclusion, two separate oil systems enable putting together an overall preassembled conductor-bushing unit including an outdoor weather housing for enclosing a pair of conductors, condenser bushings, and current transformer all of which are mounted on a transformer tank cover.

Without oil, the preassembled unit weighs less and is easier to handle during assembly and subsequent installation into the tank. Both oil systems are then filled to the proper oil levels.

The two oil systems are separated on the basis of oil purity. To minimize breakdowns between the conductors the oil surrounding them has higher purity and is more sensitive to moisture and contamination than a less costly oil in the tank.

Moreover, inasmuch as there is less volume in the preassembled unit than in prior art structures which have only one oil system, less oil is required in the unit which, in turn, allows for the use of a smaller bushing bowl with less oil expansion space.

Finally, by using a spring-compression unit, the conductor-bushing assembly has a resilience that is lacking in the prior art structure in which the several joints between the housing bowl, bushings (porcelain), and the tank cover were secured together by cement and therefore are rigid or fractural and less resistant to seismic shock due to earthquakes.

What is claimed is:

1. A current transformer comprising:

(a) a transformer tank having a cover on the tank forming a first chamber of a first oil system;

(b) a pair of elongated conductors extending through the cover and into the tank with each conductor having external and internal end portions within the tank;

(c) tubular shell means around each conductor forming separate and intercommunicating portions of a second chamber of a second oil system;

(d) a connector interconnecting the internal end portions of the conductors;

(e) the assembly of the pair of conductors and the connector forming primary conductor means;

(f) a magnetic core in inductive relation with windings around the primary conductor means; and (g) said cover forming a common interface between the first and second oil systems to enable separate assembly of the second oil system prior to its placement in the tank.

2. The current transformer of claim 1 in which said shell means includes first and second shell portions around said external and internal end portions, respectively, said first and second shell portions having end walls in fluid-tight abutment with the opposite surfaces of said tank cover.

3. The current transformer of claim 2 in which there are mounting means for resiliently biasing the conductors in tension while compressing the shell portions for holding together the assembly of the conductors, tank cover, and said shell portions as a preassembled unit.

4. The current transformer of claim 3 in which the mounting means includes spring means disposed between the first shell means and the external end portion of the conductors.

5. The current transformer of claim 4 in which the spring means are disposed between the second shell means and the internal end portions of the conductors.

6. The current transformer of claim 3 in which the second shell means includes a first electrically conductive tube around each conductor and a dielectric tube around each conductor and in end-to-end abutment with the corresponding first electrically conductive tube, and a secondary winding means being around one of the first electrically conductive tubes.

7. A current transformer comprising:

(a) a transformer tank having a cover and the tank being adapted to contain a first insulative fluid;

(b) a pair of elongated conductors extending through the cover and into the tank with each conductor having external and internal end portions within the tank;

(c) first tubular dielectric shell means around the external portions of the conductors and in fluid-tight abutment with the cover;

(d) second tubular shell means around the internal portions of the conductors and including an electrically conductive tube and a dielectric tube around each conductor, which tubes are in end-to-end abutment;

(e) the first and second shell means having intercommunicating chambers adapted to contain a second insulative fluid;

(f) a magnetic core in inductive relation with windings around one of the electrically conductive tubes; and (g) mounting means for resiliently biasing the conductors in tension while compressing the first and second shell means for holding together the assembly of the conductors, tank cover, and said shell means as a preassembled unit.

* * * * *